US007963050B2

(12) United States Patent
Sartor et al.

(10) Patent No.: US 7,963,050 B2
(45) Date of Patent: Jun. 21, 2011

(54) SPORTS BOOT WITH ARTICULATED UPPER CUFF TO PROVIDE A POSITION FOR WALKING

(75) Inventors: Paolo Sartor, Montebeluna (IT); Andrea Fregoni, Paese (IT)

(73) Assignee: Lisa Lange International SARL, Fribourg (CH)

( * ) Notice: Subject to any disclaimer, the term of this patent is extended or adjusted under 35 U.S.C. 154(b) by 923 days.

(21) Appl. No.: 11/973,789

(22) Filed: Oct. 10, 2007

(65) Prior Publication Data

US 2008/0172907 A1 Jul. 24, 2008

(30) Foreign Application Priority Data

Oct. 11, 2006 (EP) ..... 06425699

(51) Int. Cl.
*A43B 5/04* (2006.01)

(52) U.S. Cl. ..... 36/118.7; 36/118.9

(58) Field of Classification Search ..... 036/117.1, 036/117.4, 118.2, 118.4, 118.7, 118.9
See application file for complete search history.

(56) References Cited

U.S. PATENT DOCUMENTS

| | | | | |
|---|---|---|---|---|
| 4,897,940 | A * | 2/1990 | Sartor | 36/117.8 |
| 5,136,794 | A | 8/1992 | Stampacchia et al. | |
| 5,265,352 | A | 11/1993 | Chemello | |
| 5,283,964 | A | 2/1994 | Chemello | |
| 5,341,584 | A * | 8/1994 | Paris et al. | 36/117.1 |
| 5,457,899 | A * | 10/1995 | Chemello | 36/118.7 |
| 5,564,204 | A * | 10/1996 | Cagliari et al. | 36/118.7 |
| 5,588,229 | A * | 12/1996 | Marmonier | 36/118.9 |
| 6,643,955 | B2 * | 11/2003 | Pierce et al. | 36/118.3 |
| 2005/0016027 | A1 | 1/2005 | Trinkaus et al. | |

FOREIGN PATENT DOCUMENTS

| | | | |
|---|---|---|---|
| DE | 39 11 012 | A | 10/1990 |
| EP | 0 521 282 | A | 1/1993 |
| EP | 0 521 283 | A | 1/1993 |
| EP | 0 740 909 | A | 11/1996 |
| FR | 2 661 076 | A | 10/1991 |
| FR | 2 857 831 | A | 1/2005 |

OTHER PUBLICATIONS

Search Report issued by European Patent Office for priority European Application No. EP 06 42 5699, report issued Mar. 8, 2007.

* cited by examiner

*Primary Examiner* — Marie Patterson
(74) *Attorney, Agent, or Firm* — Frommer Lawrence & Haug LLP; Ronald R. Santucci

(57) ABSTRACT

Ski boot comprising a shell (1; 21; 41; 61) surrounding the foot and an upper cuff (2; 22; 42; 62) articulated to the shell, comprising a device for fastening and unfastening the upper cuff relative to the shell, this device being connected to a fastening and unfastening member by a cable (10; 30; 50; 70), this fastening and unfastening device being in a first, fastened, configuration when the fastening and unfastening member is in a first position in which the upper cuff is kept in a predefined inclined position relative to the shell, and in a second, unfastened, configuration when the fastening and unfastening member is in a second position in which the upper cuff is able to move relative to the shell so that it can be stood up straight, wherein the connection between the cable (10; 30; 50; 70) and the boot fastening and unfastening member is such that moving the fastening and unfastening member from the first to the second position introduces tension into the cable, this cable being directly connected to a control element (8; 28; 48; 68) able to change the configuration of the upper cuff fastening and unfastening device by action on a cam surface (9; 29; 49; 69).

18 Claims, 21 Drawing Sheets

SPORTS BOOT WITH ARTICULATED UPPER CUFF TO PROVIDE A POSITION FOR WALKING

This application claims priority benefits from European Patent Application No. 06425699.3 filed Oct. 11, 2006, the disclosure of which is hereby incorporated by reference.

BACKGROUND OF THE INVENTION

The invention relates to a sports boot in the form of a rigid upper made up of an upper cuff articulated to a shell surrounding the foot and equipped with a device for fastening the upper cuff to the shell in order to fasten the upper cuff in an inclined position relative to the shell in a first position for practicing the sport, and to unfasten the upper cuff from the shell in a second position for not practicing the sport, for example to make the boot easier to put on and to walk in. The invention is specifically concerned with the device for fastening the upper cuff to the shell, the operation of which is linked to a remote fastening and unfastening member, such as a lever connected to the means used to fasten and tighten the sports boot, for example.

DESCRIPTION OF THE PRIOR ART

Document FR2661076 discloses various solutions of the prior art for such fastenings applied to ski boots.

According to a first solution, the device for fastening the upper cuff to the shell relies on a rocker positioned on the upper cuff and collaborating with a stop piece belonging to the shell, the operation of which is controlled by a buckle used to open the boot via a connecting cable. When the skier wishes to rest or to walk, he undoes the boot buckle, and this has the effect of releasing the tension in the cable, which causes the rocker to change position particularly under the effect of a spring, so as to unfasten the upper cuff and allow it to pivot into a position close to vertical, suitable for walking, and into a position for resting or putting the boots on and taking them off. The disadvantage with this solution stems from the fact that the unfastening of the upper cuff relies on the release of the cable, and this often does not have enough of an effect to operate the unfastening procedure. The skier sometimes has to assist the mechanism by hand, by pressing against the boot in order to achieve the unfastened position. Furthermore, the existing mechanisms are complicated and expensive and are not very good at converting the significant travel of the cable into a short travel of the rocker. For all of these reasons, this first solution is not suitable.

A second solution reuses the essential features of the mechanism, that is to say a rocker connected by a cable to a buckle of the boot. However, in this solution, the rocker is actuated by pulling the cable, this being brought about by opening the boot buckle. This principle guarantees better unfastening of the upper cuff. However, this solution has the disadvantage of being highly complex because it relies on a first spring to compensate for the differences between the long travel of the cable and the small-amplitude of the movement of the rocker, and then on a second spring to actuate the rocker.

SUMMARY OF THE INVENTION

A general subject of the present invention is a sports boot with a device for fastening/unfastening the upper cuff with respect to the shell but not having the disadvantages of the prior art.

More specifically, a first subject of the present invention is a sports boot with a fastening/unfastening device that performs well, particularly in the phase of unfastening the upper cuff.

The second subject of the present invention is a sports boot with a fastening/unfastening device the mechanism of which is simple, not very bulky, and inexpensive.

The invention relies on a solution involving tension in the cable in order to unfasten the upper cuff, in combination with an element for controlling this unfastening that uses a cam surface.

The invention is more specifically defined by the claims.

DESCRIPTION OF THE DRAWINGS

These objects, features and advantages of the present invention will be explained in detail in the following description of some particular embodiments given without any implied limitation with reference to the attached figures among which.

DESCRIPTION OF THE PREFERRED EMBODIMENTS

Figure 1:
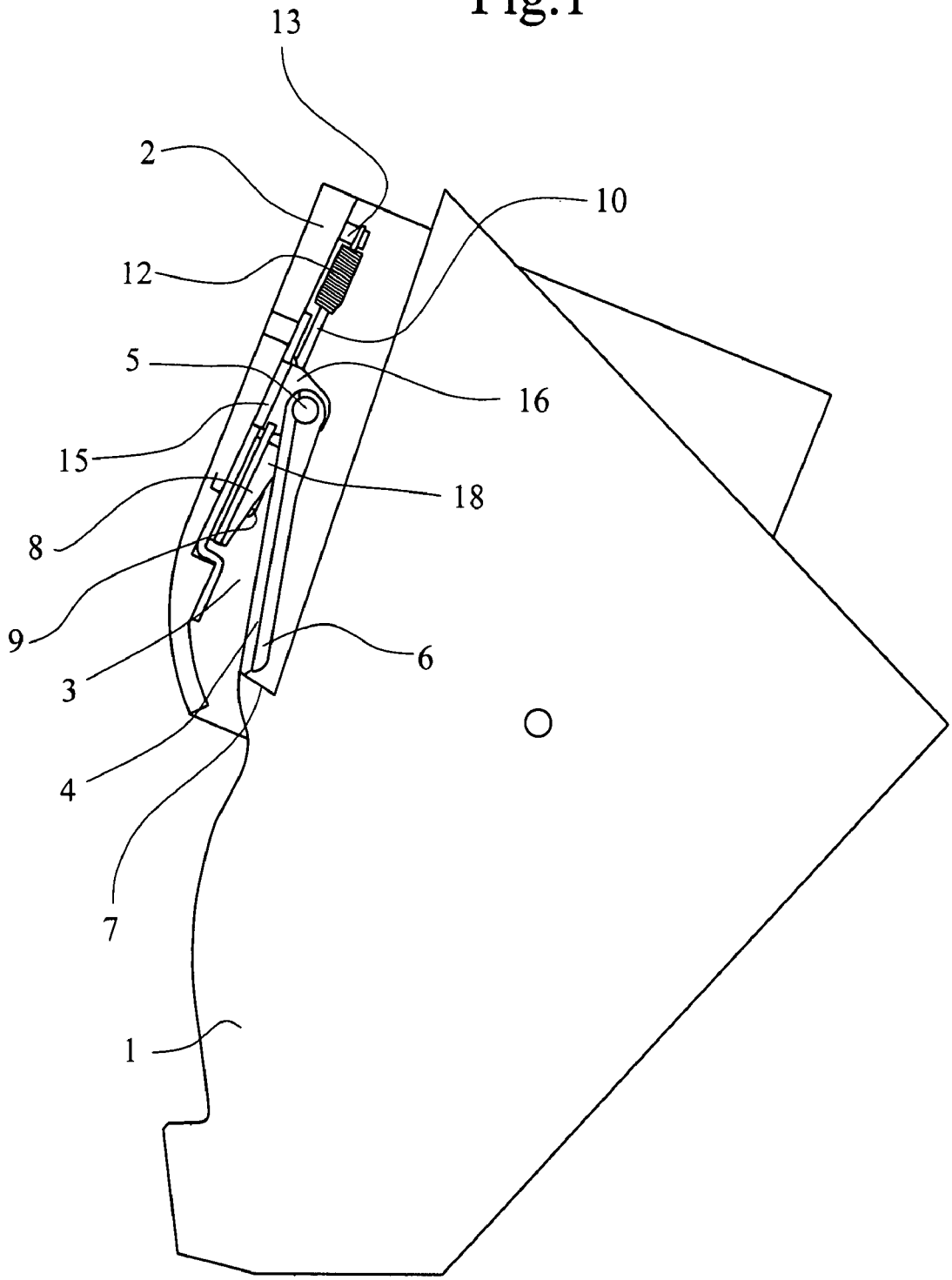
FIG. 1 is a side view in section on a vertical plane of part of a boot with a fastening mechanism according to a first embodiment of the invention, in a fastened position.
Figure 2:
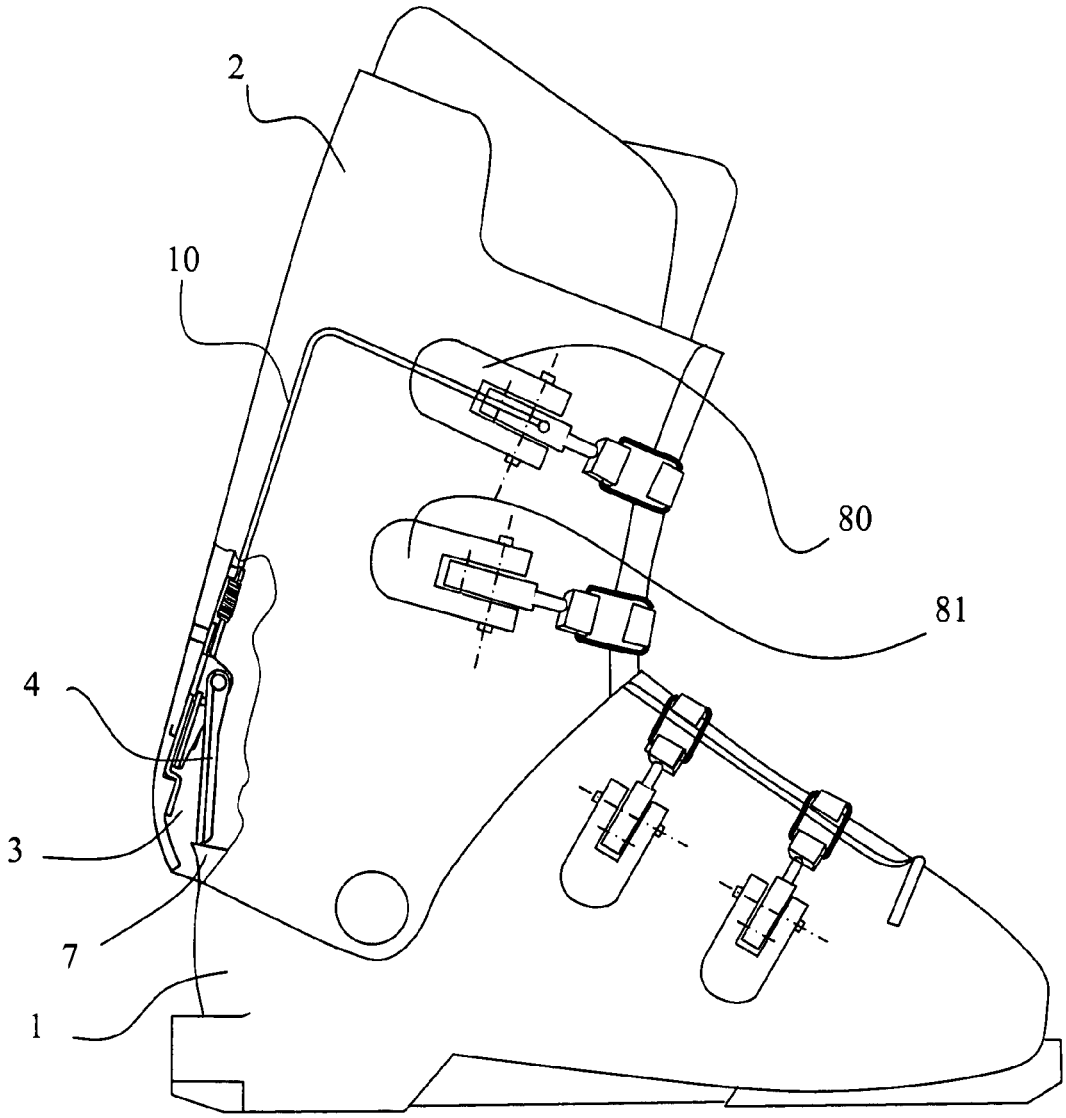
FIG. 2 is a side view of a ski boot incorporating a fastening mechanism according to the first embodiment of the invention, in a fastened position.
Figure 3:
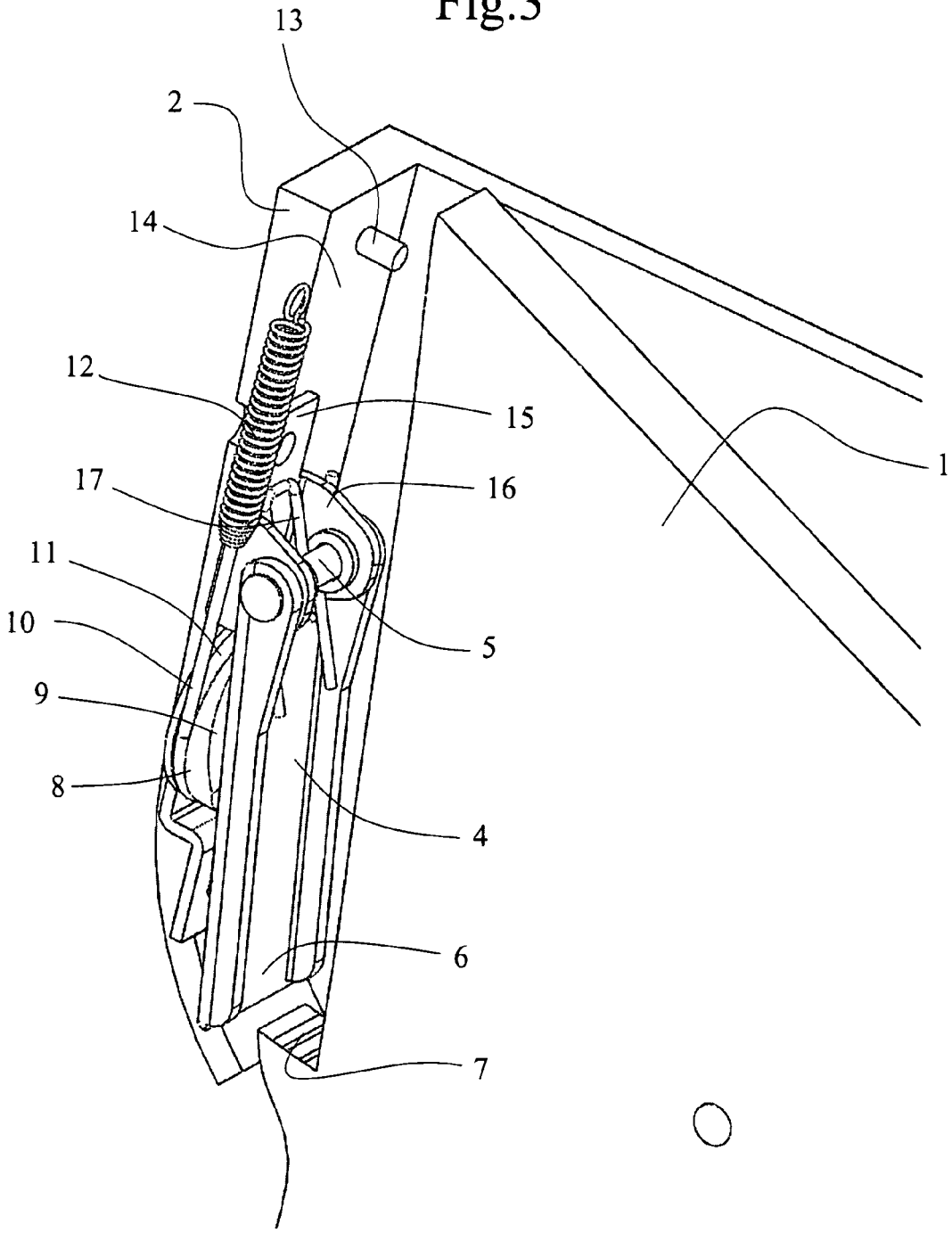
FIG. 3 is a perspective view of the fastening mechanism according to the first embodiment of the invention.

The invention will be described in its application to a ski boot. However, it could be applied to any kind of sports boot or shoe with a rigid upper, that is to say an upper comprising an upper cuff and a shell substantially made of a material at least as rigid as a polyurethane with a hardness of 40 Shore D.

According to the first embodiment of the invention illustrated in FIGS. 1 to 5, the upper cuff 2 is connected to the shell 1 by a rear fastening/unfastening device positioned in a housing 3 provided between the two elements. The fastening/unfastening device relies on a rocker 4 mounted such that it can move in terms of rotation about a pivot 5 secured to the upper cuff and which has a lower free end 6 that can collaborate with a stop piece 7 belonging to the shell 1. The device further comprises a rotary component 8 of the drum type, mounted such that it can move on the upper cuff, in the form of a disk of which the opposite surface to the one facing the interior surface 14 of the upper cuff has an irregular relief so as to form a cam surface 9 which collaborates with the rocker 4. This drum 8 comprises a hollowed annular part 11 to accept a cable 10 over its circumference. The cable 10 has a first end connected to a fastening and unfastening member, which corresponds to the upper fastening and tightening buckle 80 of the upper cuff 2, and a second end connected to the drum 8 subjected to a return spring 12 fixed to the upper cuff 2 at a point 13. This return spring 12 acts on the drum 8 via a direct connection with the end of the cable 10. However, a spiral-shaped spring positioned within the drum could perform an equivalent return function. This device is secured to the interior surface 14 of the upper cuff 2 by at least one support and reinforcing plate 15 comprising arms 16 between which the substantially horizontal pivot 5 is mounted parallel to the wall 14 of the rocker 4. This plate 15 additionally comprises a housing for the pivot perpendicular to the wall 14 of the drum 8. A spring 17 positioned at the pivot 5 acts on the rocker 4 to cause it to tend to rotate in the direction that moves it away from the shell 1 and therefore towards the position in which the upper cuff 2 is unfastened.

FIG. 1 illustrates the fastened position of the upper cuff 2, which occupies an inclined position optimal for skiing relative to the shell 1. In this configuration, the cable 10 is released but kept taut, its end occupying a raised position in the space 3 under the effect of the spring 12. This position of the cable 10 corresponds to a position of the drum 8 in which the thickest portion 18 of its cam surface 9 bears against the rocker 4 so as to keep the end 6 thereof pressed against the stop piece 7 belonging to the shell. In this configuration in which the rocker 4 is in abutment against the stop piece, the upper cuff 2 cannot straighten up and therefore does remain in the fastened inclined position needed for skiing.

Figure 4:
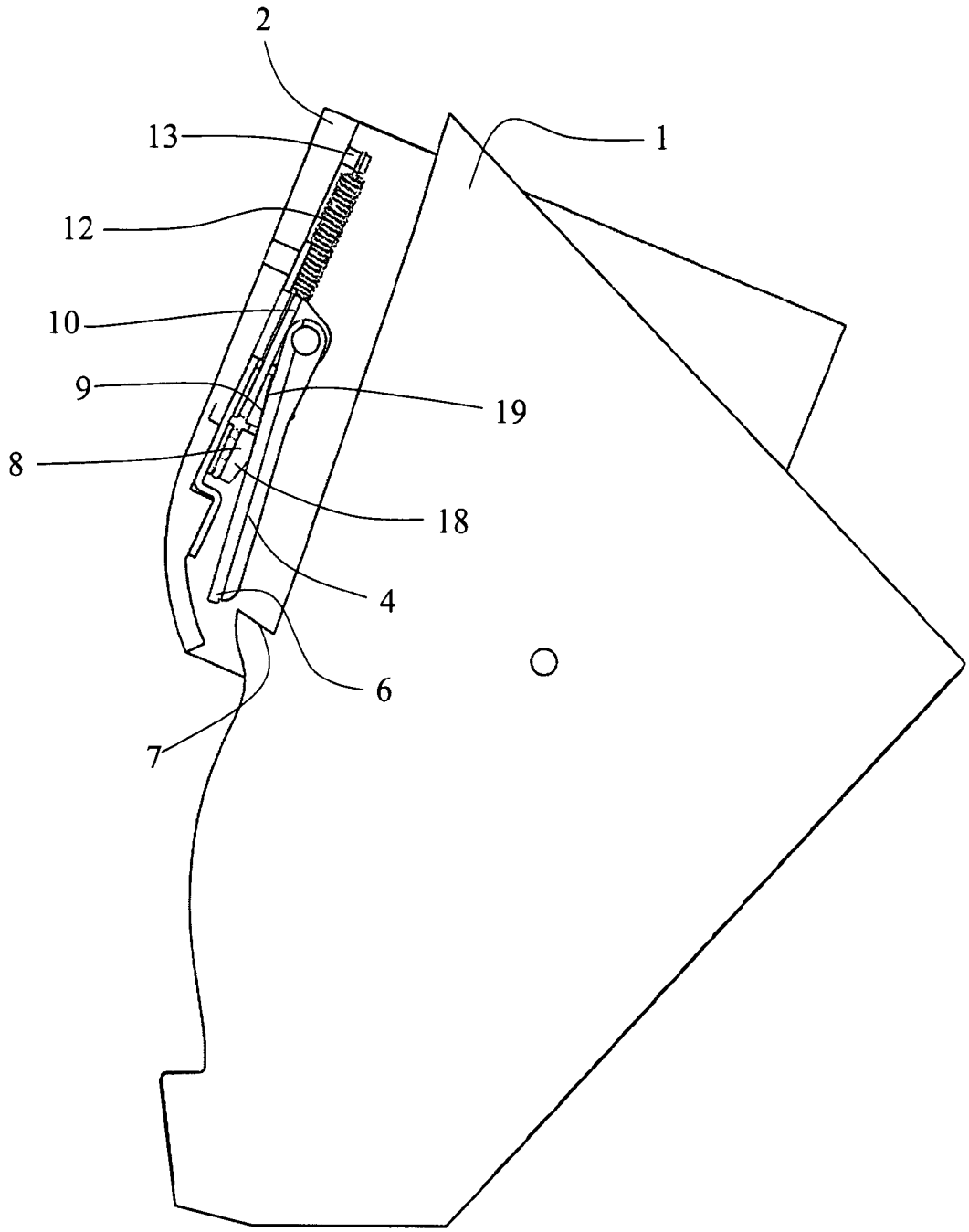
FIG. 4 is a side view in section on a vertical plane of part of a boot with a fastening mechanism according to the first embodiment of the invention, in an unfastened position.
Figure 5:
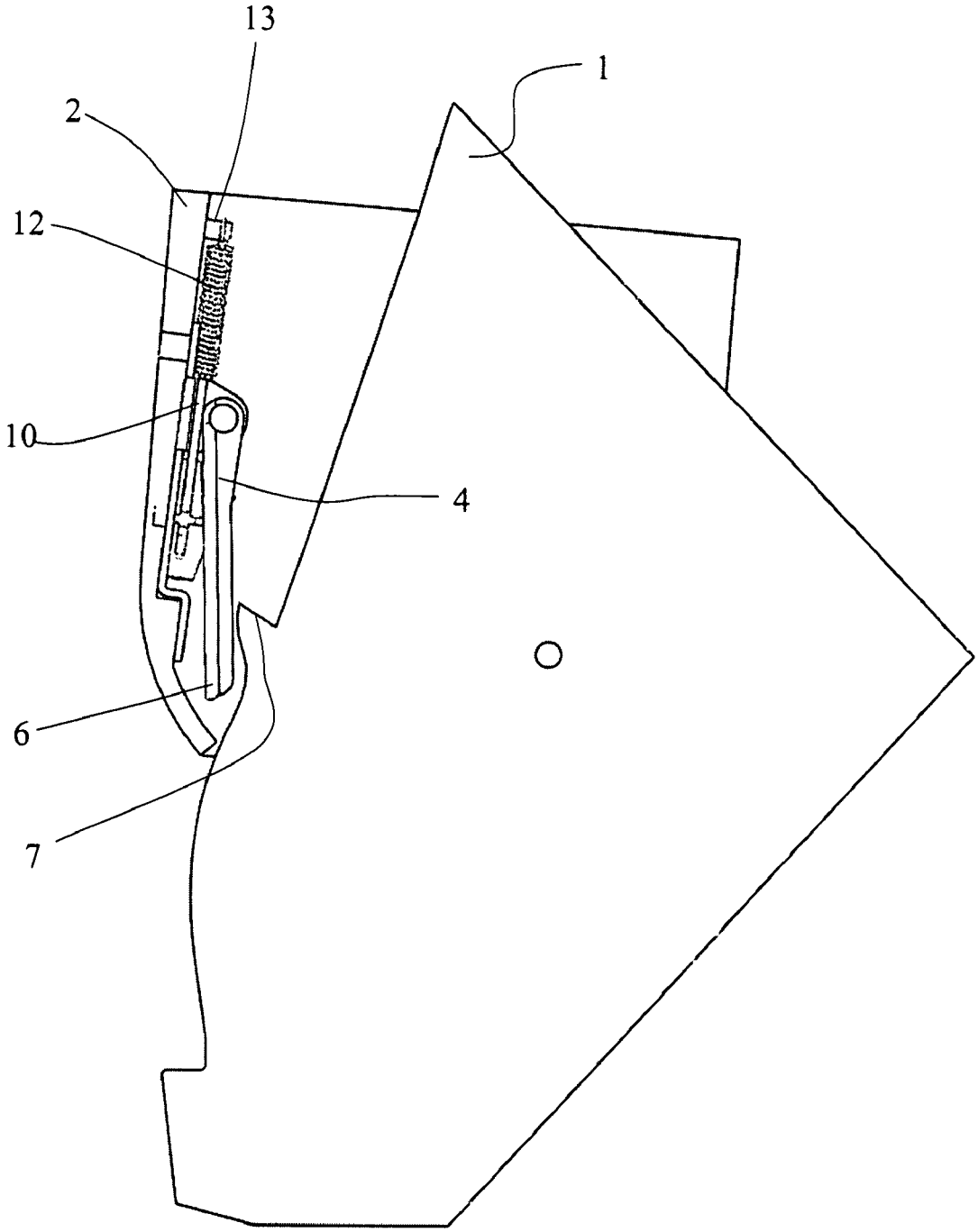
FIG. 5 is a side view in section on a vertical plane of part of a boot with a fastening mechanism according to the first embodiment of the invention, in an unfastened position with the upper cuff standing up straight.

FIGS. 4 and 5 illustrate the unfastened configuration of the upper cuff 2. By opening the fastening buckle 80 to which the cable 10 is fixed, the skier introduces tension into the cable and this causes the drum 8 to rotate through half a revolution allowing the thickest part 18 of the cam surface 9 to be directed downwards, while the thinner surface 19 finds itself positioned towards the top, thus releasing the rocker 4 which moves away from the shell 1 under the effect of the return spring 17 while at the same time remaining in contact with the cam surface 9 of the drum 8. The geometry of the cam surface 9 of the drum 8 is such that it allows the end 6 of the rocker 4 to escape the actions of the stop piece 7 of the shell 1 in this configuration. Thus, the upper cuff 2 is properly unfastened and is free to pivot backwards with respect to the shell, until it reaches an almost vertical position as illustrated in FIG. 5. This last position makes it easier to walk in the boot and makes it easier to put the boot on and take it off.

The diameter of the drum 8 is specifically chosen so that the travel of the cable 10 when closing or opening the boot buckle 80 causes it to rotate through half a revolution. The diameter of the drum 8, combined with the geometry of its cam surface 9 allows the long travel of the cable 10 to be converted in a very simple way into a small movement of the rocker 4. Closing the boot buckle conversely allows the rocker 4 to be pushed back into the fastened position of FIG. 1 as soon as the upper cuff is returned to the inclined position.

FIGS. 6 to 10 illustrate a second embodiment of the invention. This relies on a rocker 24 mounted such that it can move elastically on a pivot 25 mounted on the rear surface of the shell 21, via a support 35 comprising arms 36 that support the pivot 25. A leaf spring 37 resting against this rocker 24 is able to return it elastically to its rest position illustrated in FIG. 6. The upper cuff 22 still comprises a drum 28 mounted such that it can move in terms of rotation on its interior surface 34 and comprising a housing 31 on its circumference to accommodate a cable 30 connected, on the one hand, to the drum 28 and to a return spring 32 to perform the drum return function, this spring being fixed to the upper cuff 22 at a point 33 and, on the other hand, to a fastening and unfastening member, not depicted, which may be a buckle used to fasten and unfasten the boot.

The way in which this second embodiment works is similar to the workings of the previous embodiment.

Figure 6:
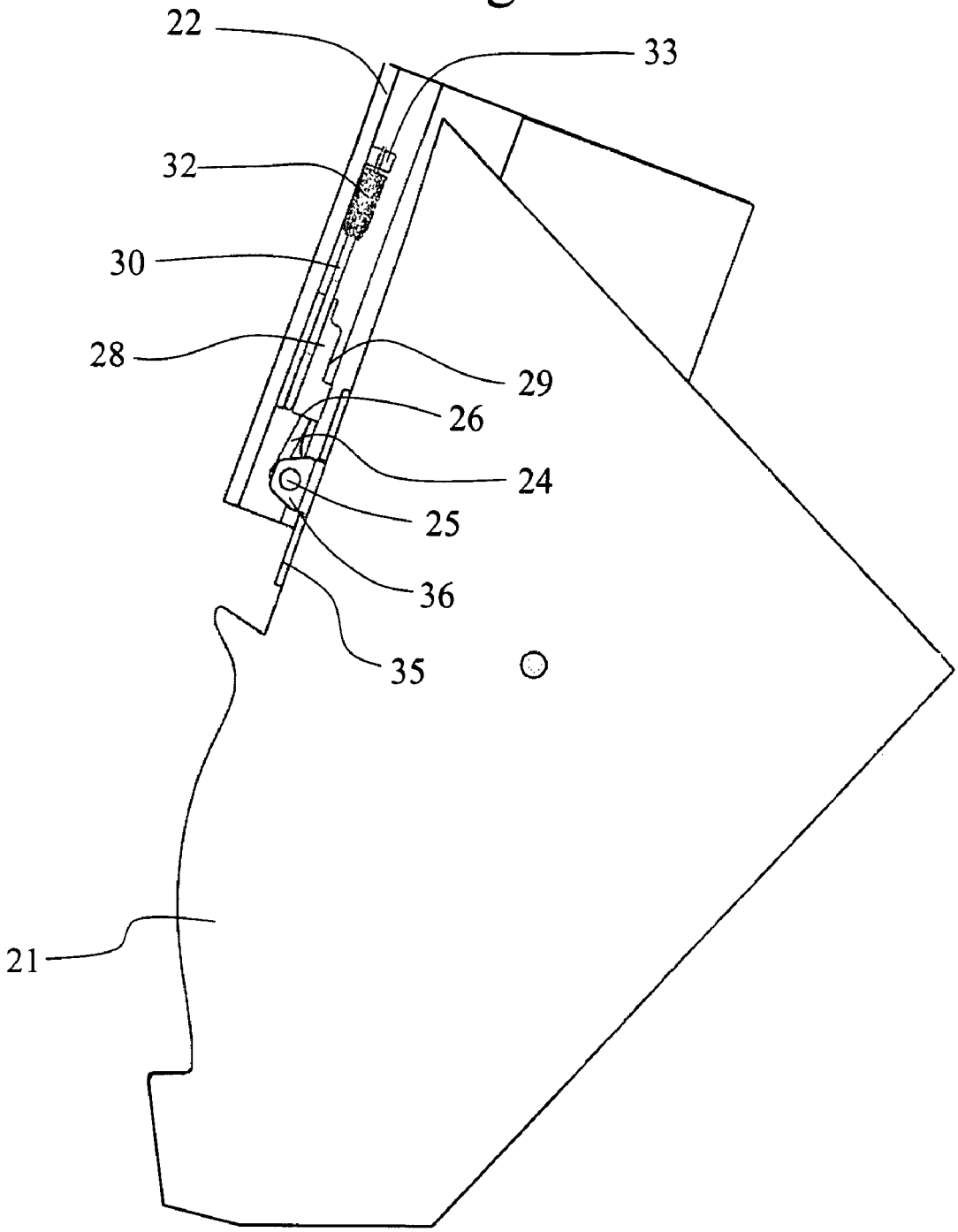
FIG. 6 is a side view in section on a vertical plane of part of a boot with a fastening mechanism according to a second embodiment of the invention, in a fastened position.
Figure 7:
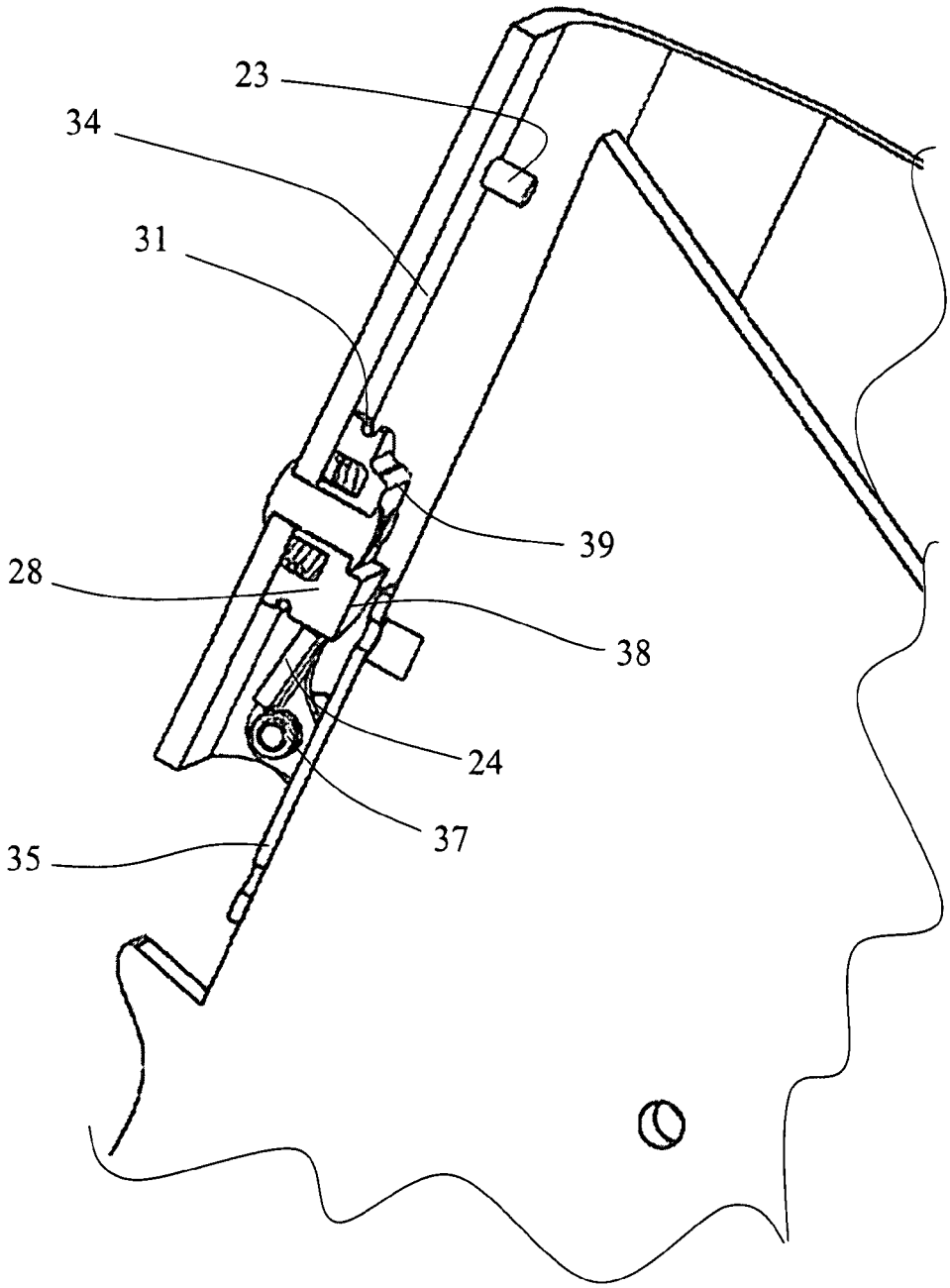
FIG. 7 is a cross section through a perspective view of the fastening mechanism according to the second embodiment of the invention.
Figure 8:
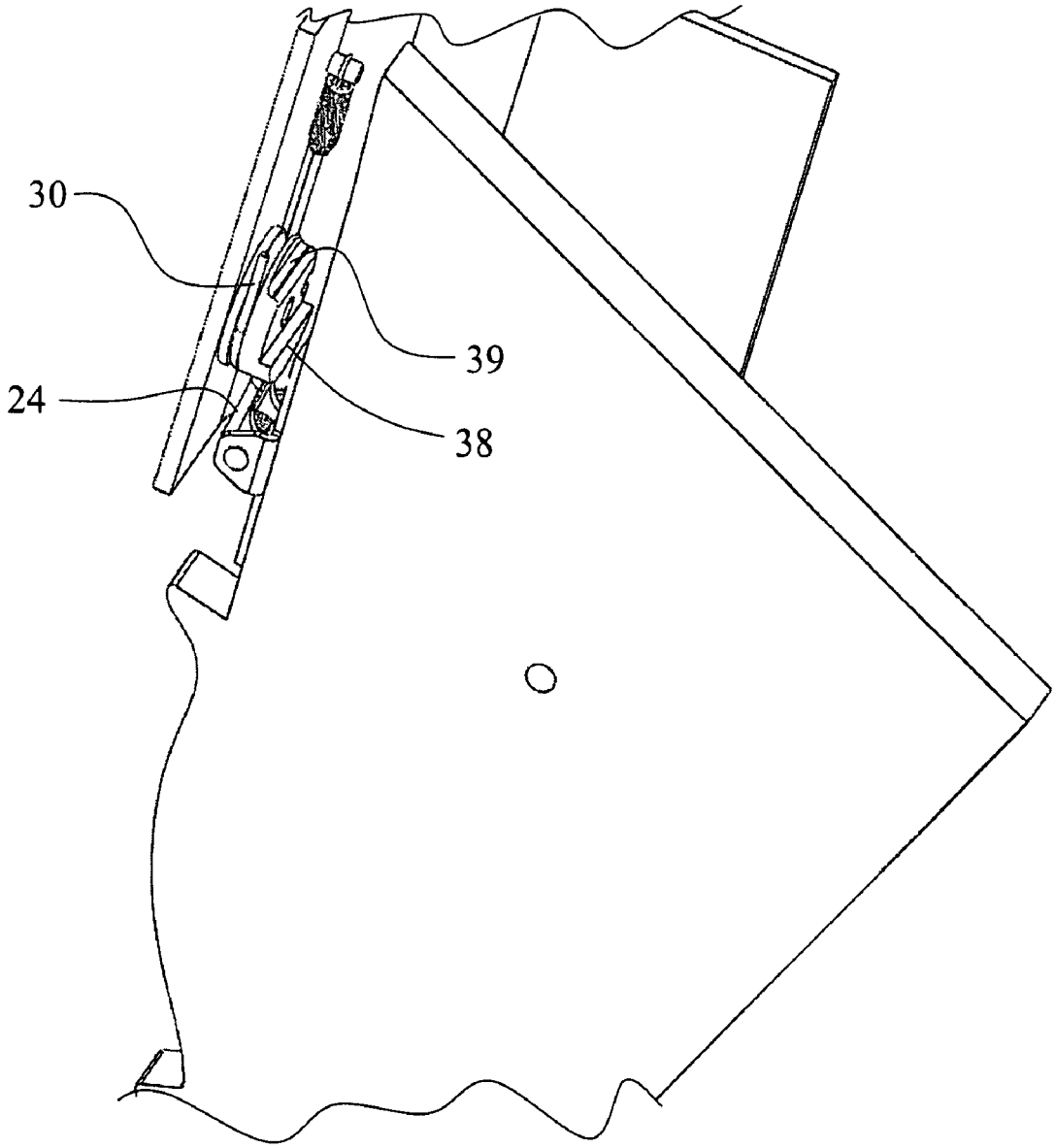
FIG. 8 is a perspective view of the fastening mechanism according to the second embodiment of the invention.
Figure 9:
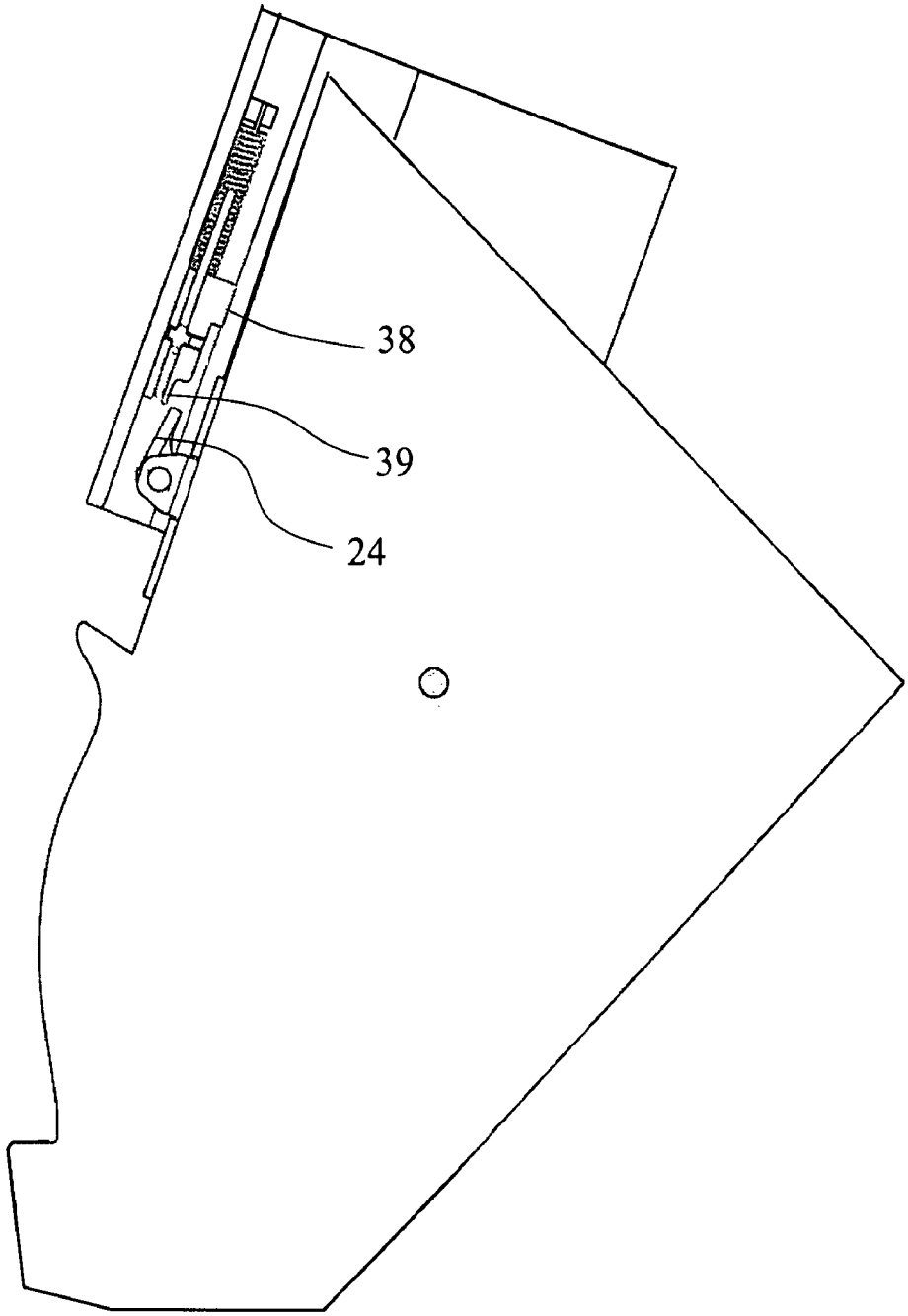
FIG. 9 is a side view in section on a vertical plane of part of a boot with a fastening mechanism according to the second embodiment of the invention, in an unfastened position.
Figure 10:
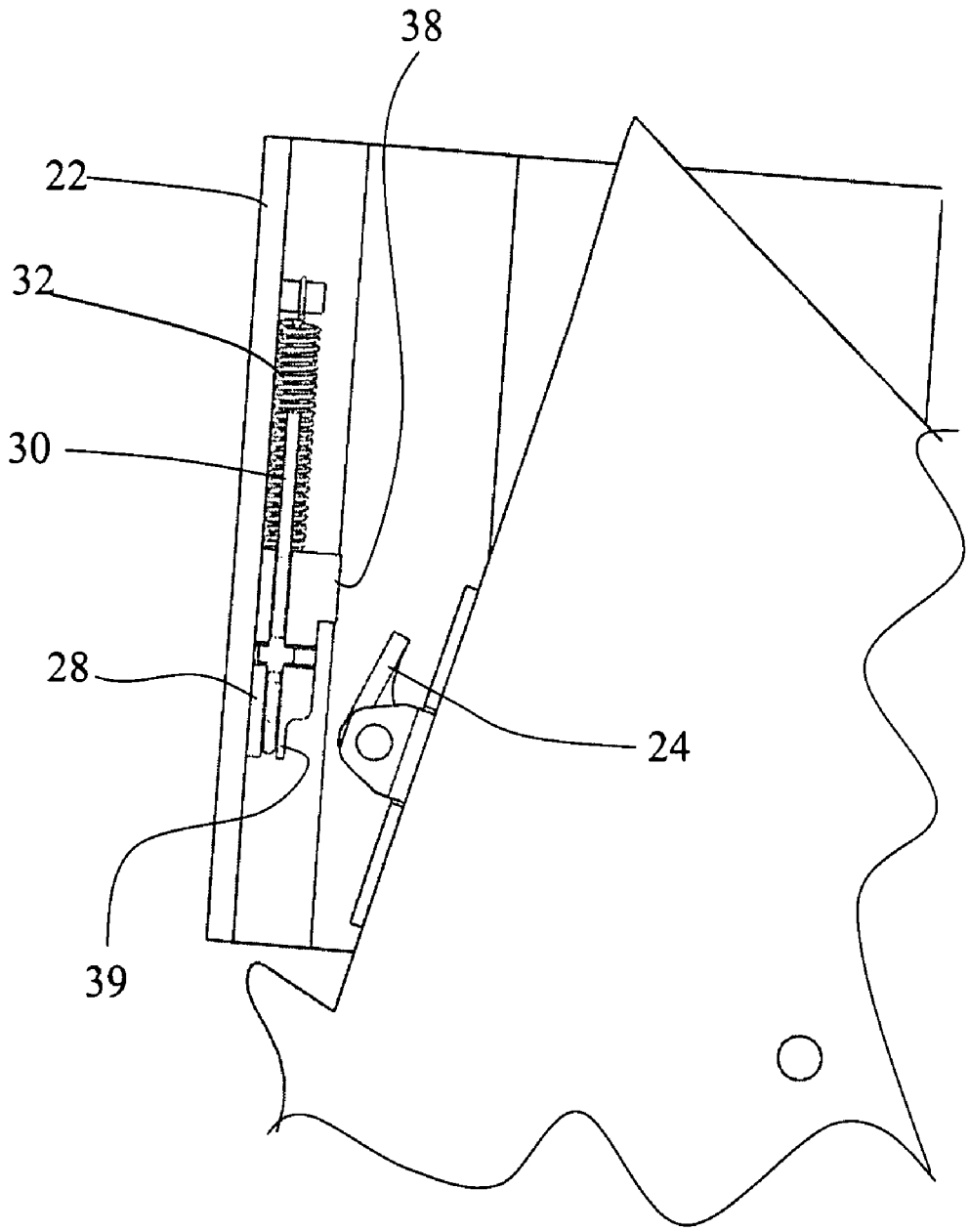
FIG. 10 is a side view in section on a vertical plane of part of a boot with a fastening mechanism according to the second embodiment of the invention in an unfastened position with the upper cuff standing up.

FIG. 6 illustrates the fastened position in which the annular surface of a thick portion 38 of the cam surface 29 of the drum 28 butts against the upper end of the rocker 24, thus preventing any standing-up straight of the upper cuff 22. When the skier unfastens his buckle, he applies tension to the cable 30 which causes the drum 28 to rotate through half a revolution, the thinnest cam surface 39 of which drum then finds itself facing the stop piece 24. This cam surface 29 is such that, in this second configuration illustrated in FIGS. 9 and 10, it escapes any contact with the stop piece 24, thus freeing the upper cuff 22 which can be stood up straight vertically into the position illustrated in FIG. 10.

Closing the buckle once again releases the cable 30 the end of which is raised back up under the effect of the spring 32, once again causing the drum 28 to rotate and return to its fastened configuration of FIG. 6. The elasticity of the rocker 24 allows the cam surface 29, in the fastened position, to move against this rocker 24 from the boot position illustrated in FIG. 10 to the fastened inclined position of FIG. 6.

FIGS. 11 to 15 illustrate a third embodiment of the invention which relies on a rocker 44 mounted such that it can move in terms of rotation about a pivot 45 on the shell 41. It is directed upward so that its end 46 collaborates with a stop piece 47 formed of an elbow of a support plate 55 fixed to the interior surface 54 of the upper cuff 42. This plate 55 has a longitudinal opening 51 forming a guideway for a slider 48, connected to the end of the cable 50. Finally, the movement of the slider 48 is thus directly connected with that of the cable, a return spring 52 positioned helically around the cable 50 in its end part and placed between a stop piece 53 belonging to the upper cuff 42 and the slider 48 allowing this slider to be returned when the cable is released. A second return spring 57 positioned on the pivot 45 about which the rocker 44 rotates exerts a force which keeps this rocker in contact with the slider 48. The rocker 44 has a cam surface 49 in the form of a hollowed shape with an initial surface 59 that is not particularly deep and a final surface 58 set at a greater depth, in order to collaborate with the slider 48.

Figure 11:
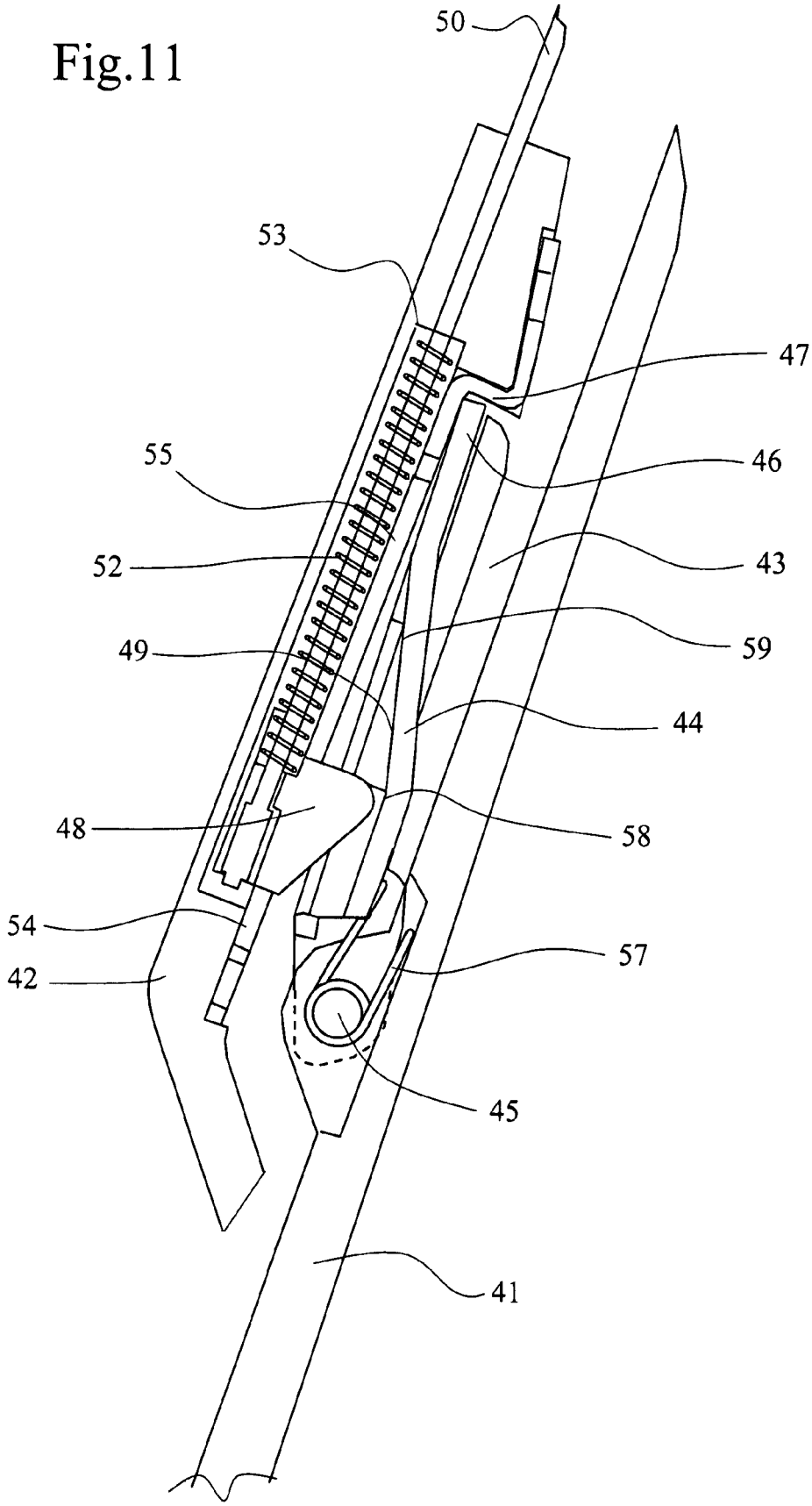
FIG. 11 is a side view in section on a vertical plane of part of a boot with a fastening mechanism according to a third embodiment of the invention, in a fastened position.
Figure 12:
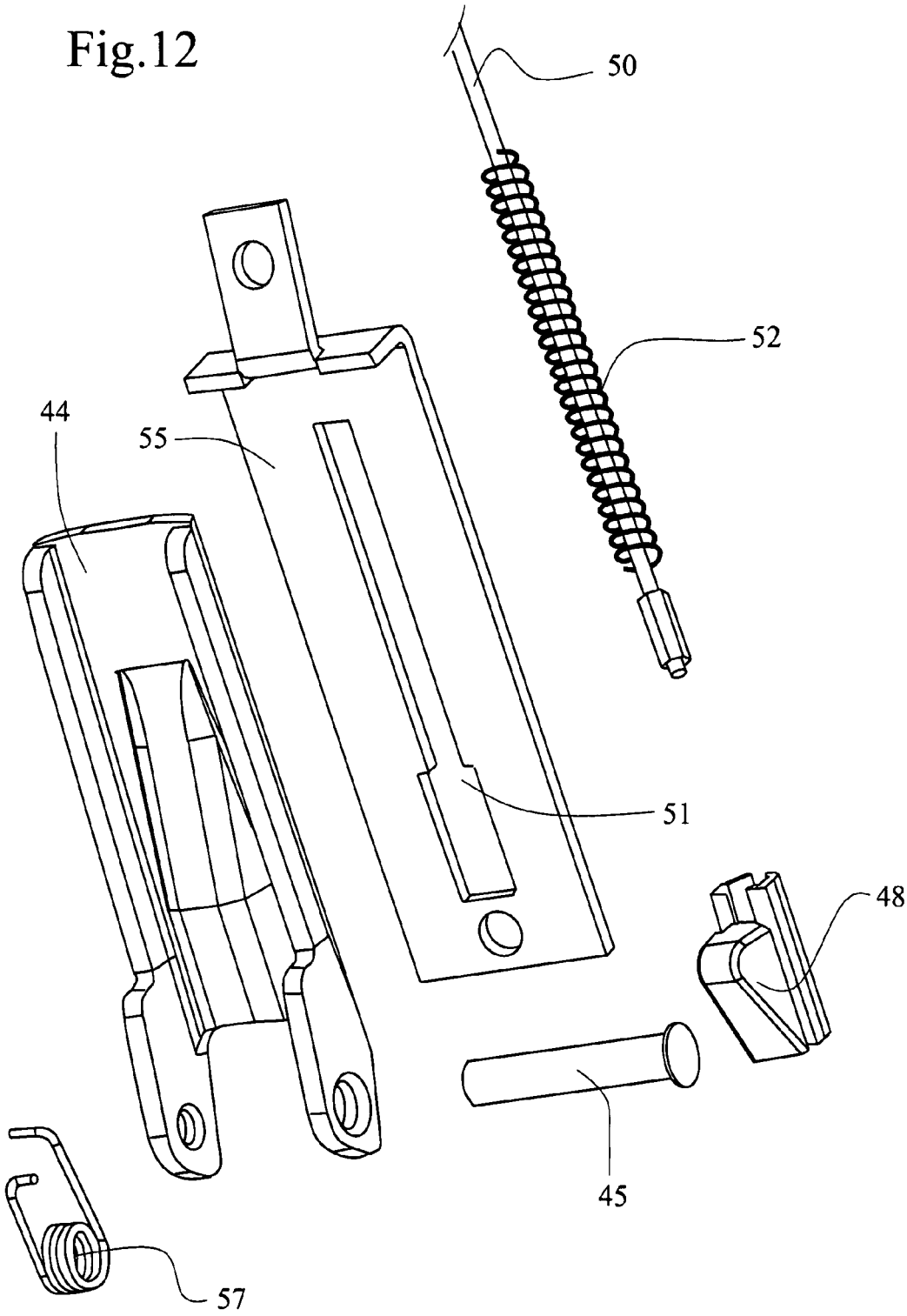
FIG. 12 is an exploded perspective view of the fastening mechanism according to the third embodiment of the invention.
Figure 13:
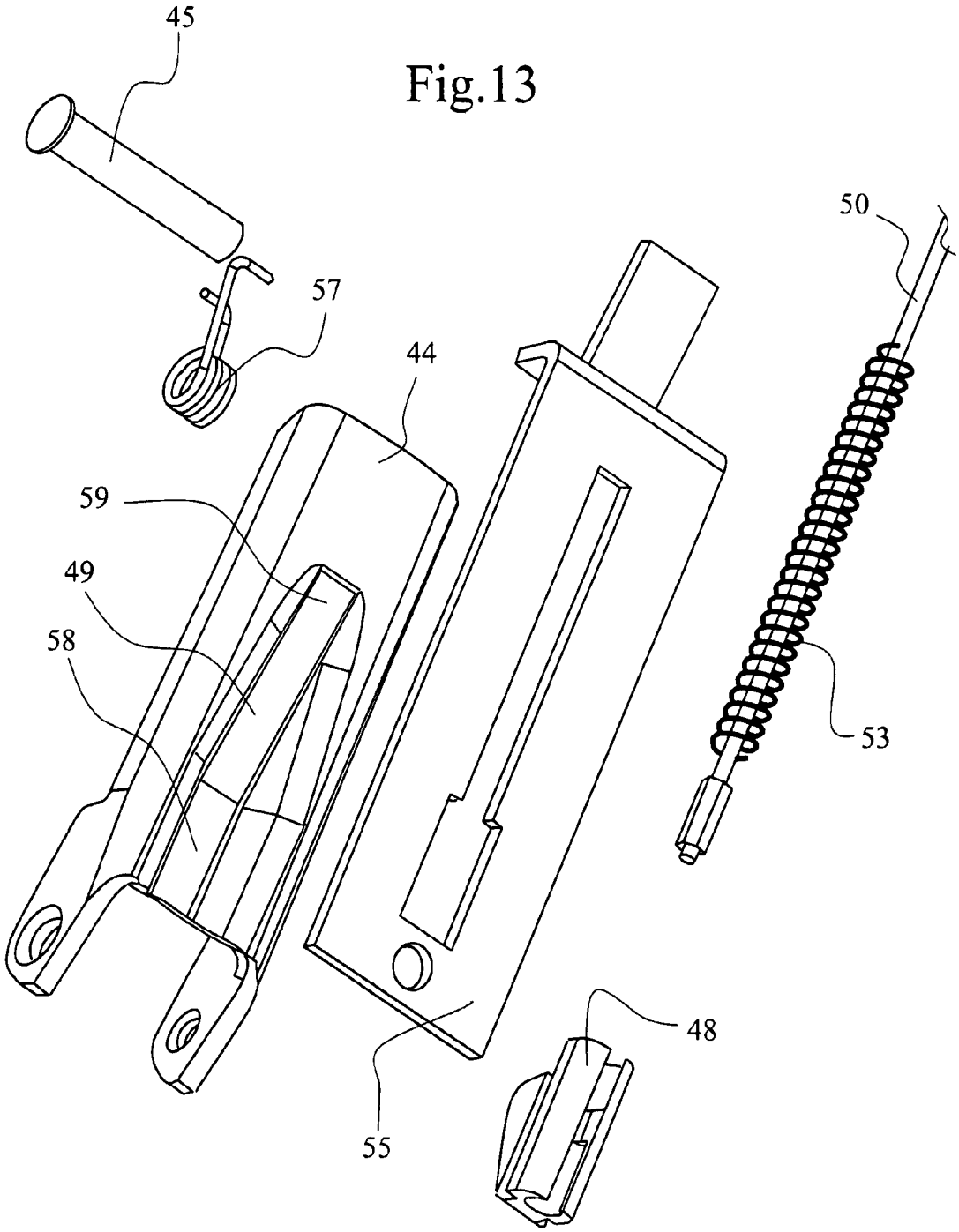
FIG. 13 is another exploded perspective view of the fastening mechanism according to the third embodiment of the invention.
Figure 14:
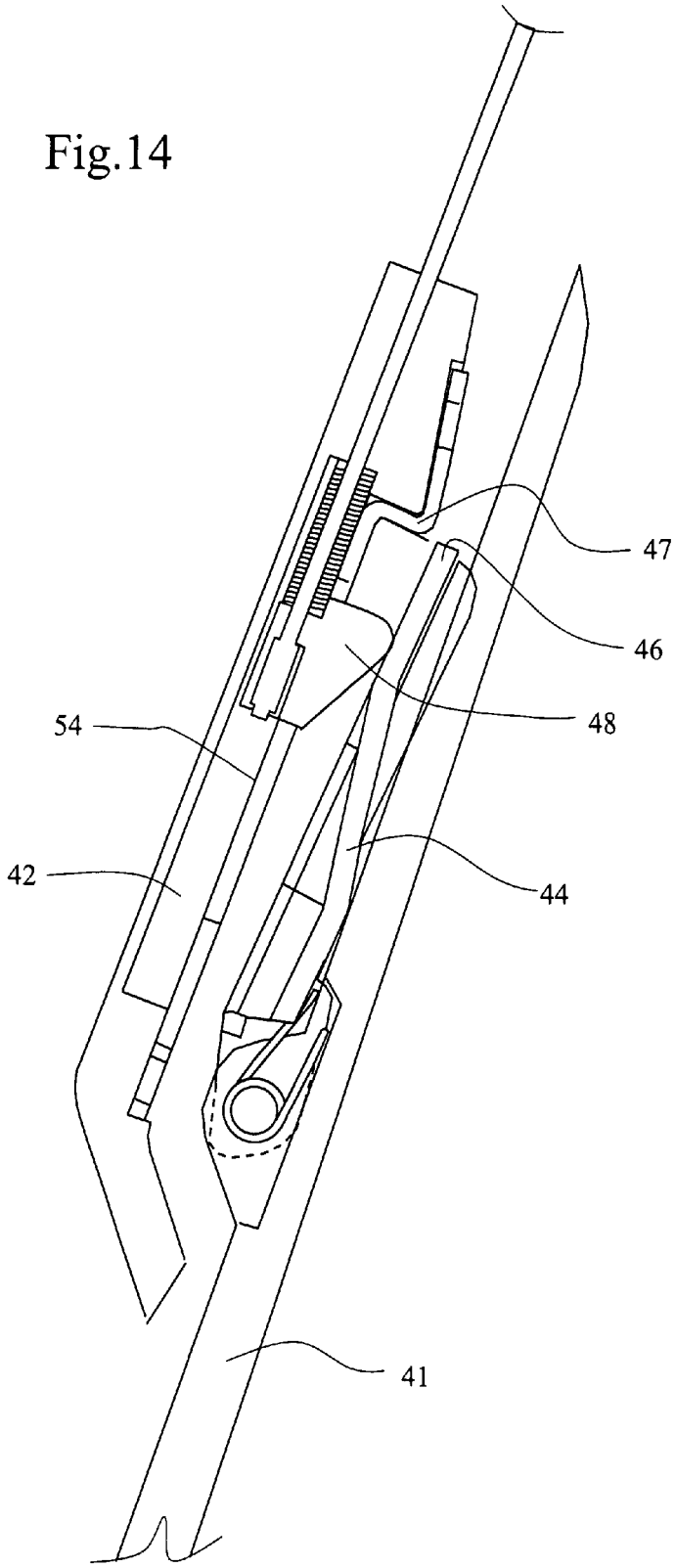
FIG. 14 is a side view in section on a vertical plane of part of a boot with a fastening mechanism according to the third embodiment of the invention, in an unfastened position.
Figure 15:
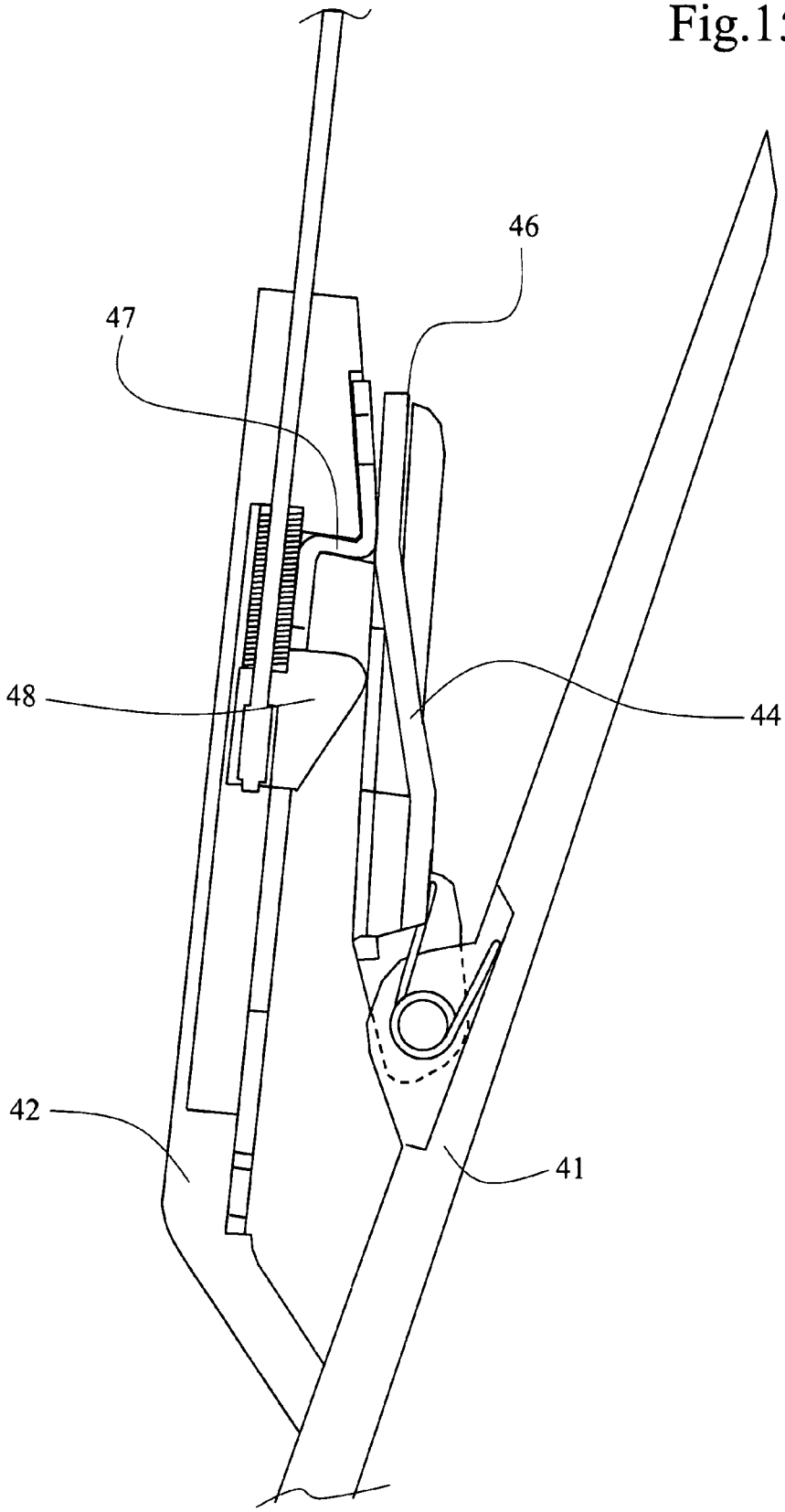
FIG. 15 is a side view in section on a vertical plane of part of a boot with a fastening mechanism according to the third embodiment of the invention in an unfastened position with the upper cuff standing up straight.

FIG. 11 illustrates the fastened position in which the cable 50 is released. In this released position, its end reaches its lowermost position, guaranteed by the spring 52 which may or may not bear against its upper limit stop piece 53. This position is accompanied by a positioning of the slider 48 at its lowermost point, resting against the deepest surface 58 of the cam surface 49 of the rocker 44. The geometry of the slider 48 and of the cam surface 49 of the rocker are chosen such that, in this position, the upper end 46 of the rocker comes into contact with the stop piece 47 of the upper cuff 42, preventing any rotation of the latter that might tend to stand it up straight. This position is provided and maintained by the return spring 57 associated with the rocker 44.

When the skier activates the fastening and unfastening member, for example by opening his boot buckle, connected to the cable 50, he applies tension to the cable 50 which causes the slider 48 to move up along its guideways within the opening 51 on the interior surface of the upper cuff 42, and the spring 52 to be compressed. During this upward movement, the slider 48 slides over the cam surface 49 of the rocker 44 which remains in permanent contact with the slider under the effect of the return spring 57 associated with the rocker. During this movement of the slider 48, the rocker 44 is driven in a rotational movement about its pivot 45 under the effect of the shape of the cam surface 49. When the slider 48 reaches its uppermost position and comes into contact with the rocker at the end of its cam surface 49, the end of the rocker 46 escapes the actions of the stop piece 47 of the upper cuff 42 so that the latter is free to be stood up straight into the configuration illustrated in FIG. 15.

In this solution, the cam surface 49 of the rocker 44 allows the long travel of the cable 50 to be converted into a small rotation of the rocker 44.

FIGS. 16 to 20 illustrate a fourth embodiment of the invention. In this solution, a rocker 64 is mounted such that it can move in terms of rotation about a pivot 65 fixed to two arms 76 of a support 75 positioned on the interior surface 74 of the upper cuff 62. The rocker 64 is in the form of a hollow body within which there is housed a slider 68 connected to the end of the cable 70, and a spring 72 bearing against the slider 68, on the one hand, and against a stop piece 73 of the rocker at its pivot 65. A spring 77 permanently acts on the rocker 64 to tend to rotate it toward the shell 61 in order to tend toward collaboration between the end of the rocker 66 and a stop piece 67 of the shell 61. Finally, one of the arms 76 of the support 75 of the rocker forms a cam surface 69 intended to collaborate with the slider 68.

Figure 16:
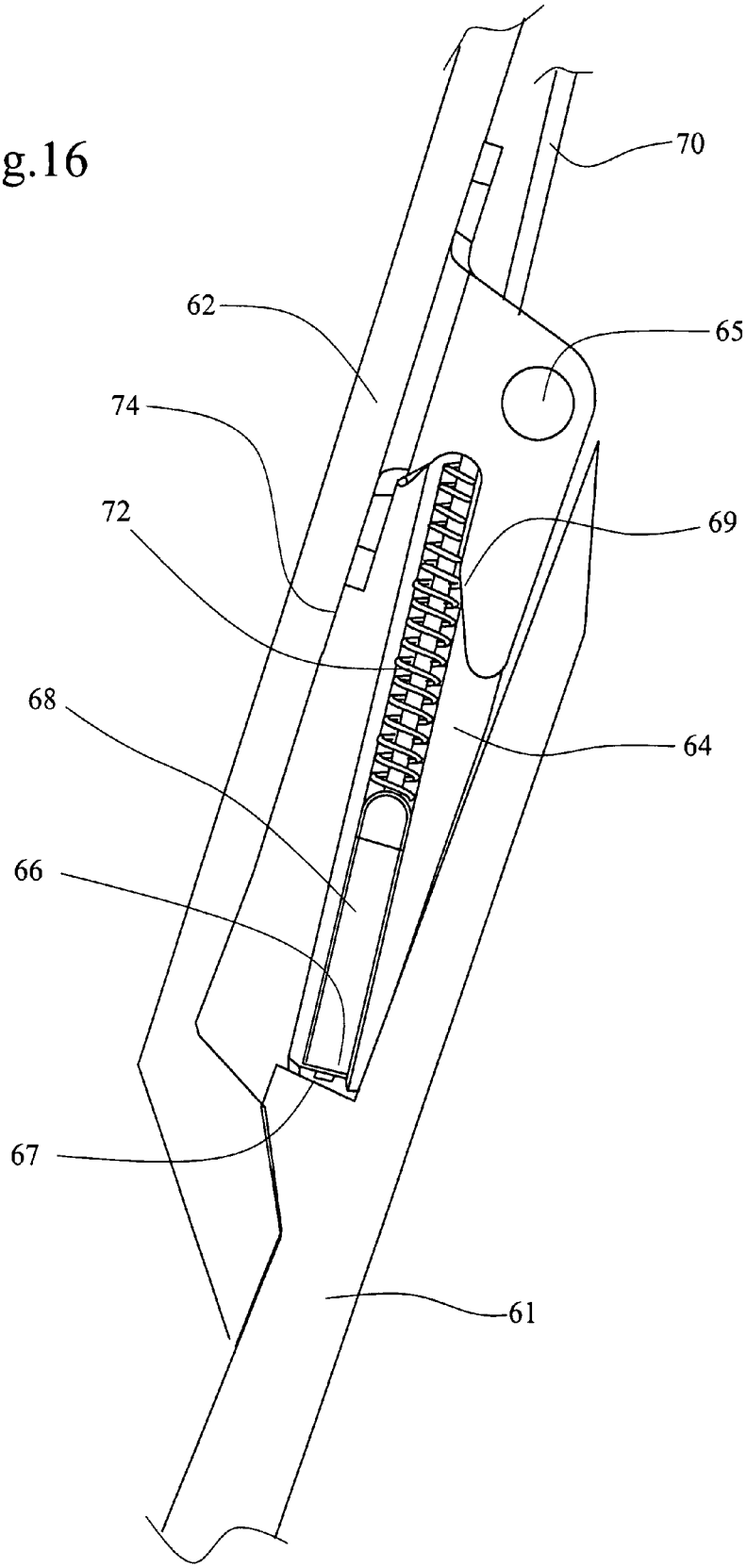
FIG. 16 is a side view in section on a vertical plane of part of a boot with a fastening mechanism according to a fourth embodiment of the invention, in a fastened position.
Figure 17:
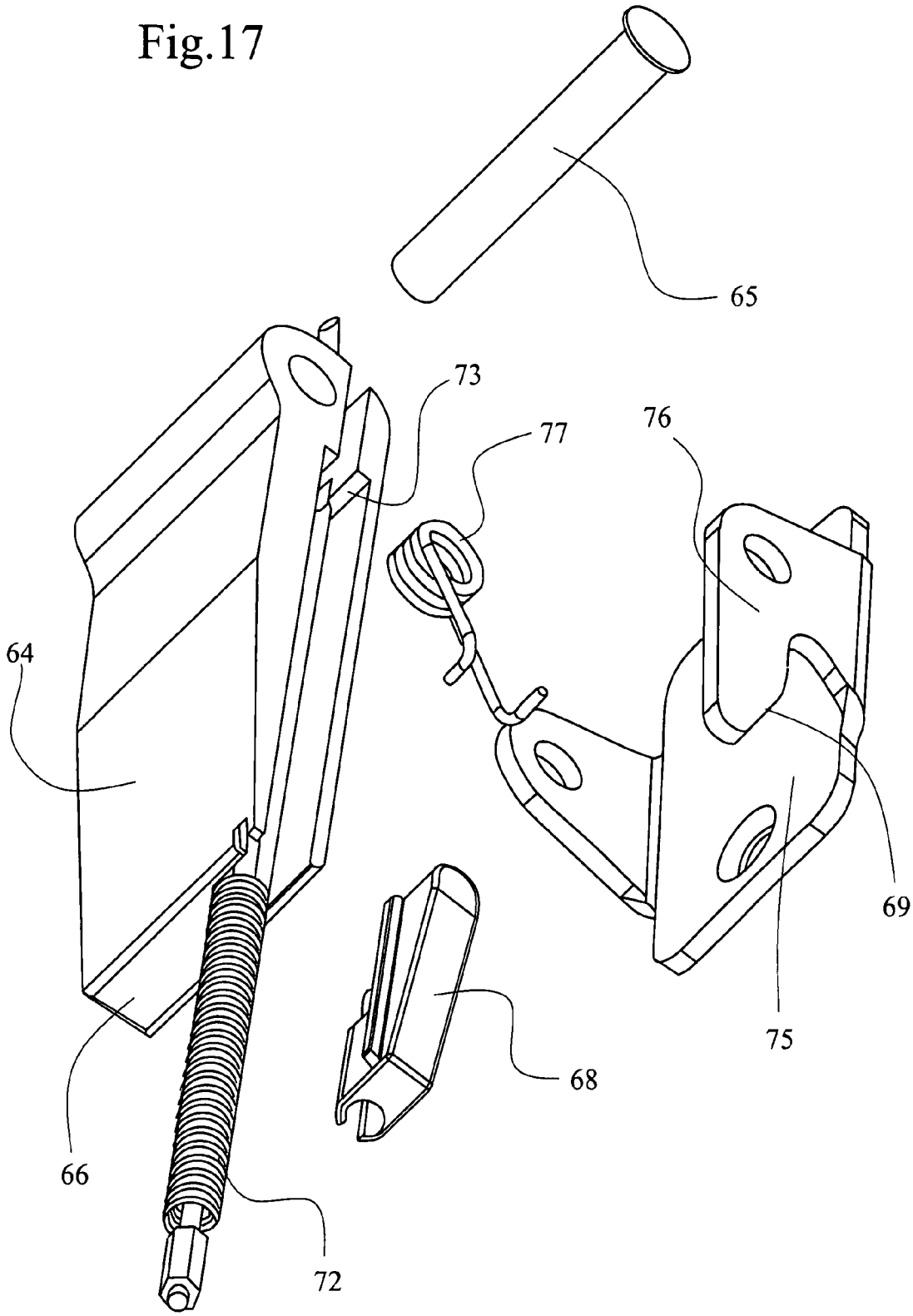
FIG. 17 is an exploded perspective view of the fastening mechanism according to the fourth embodiment of the invention.

FIG. 16 illustrates the fastened position in which the cable 70 is released, leading to the slider 68 being positioned toward the end 66 of the rocker 64 under the effect of the spring 72. The spring 77 keeps the end 66 of the rocker 64 pressed against the stop piece 67 of the shell 61, thus preventing any rotation of the upper cuff 62 which maintains its fastened inclined position.

Figure 18:
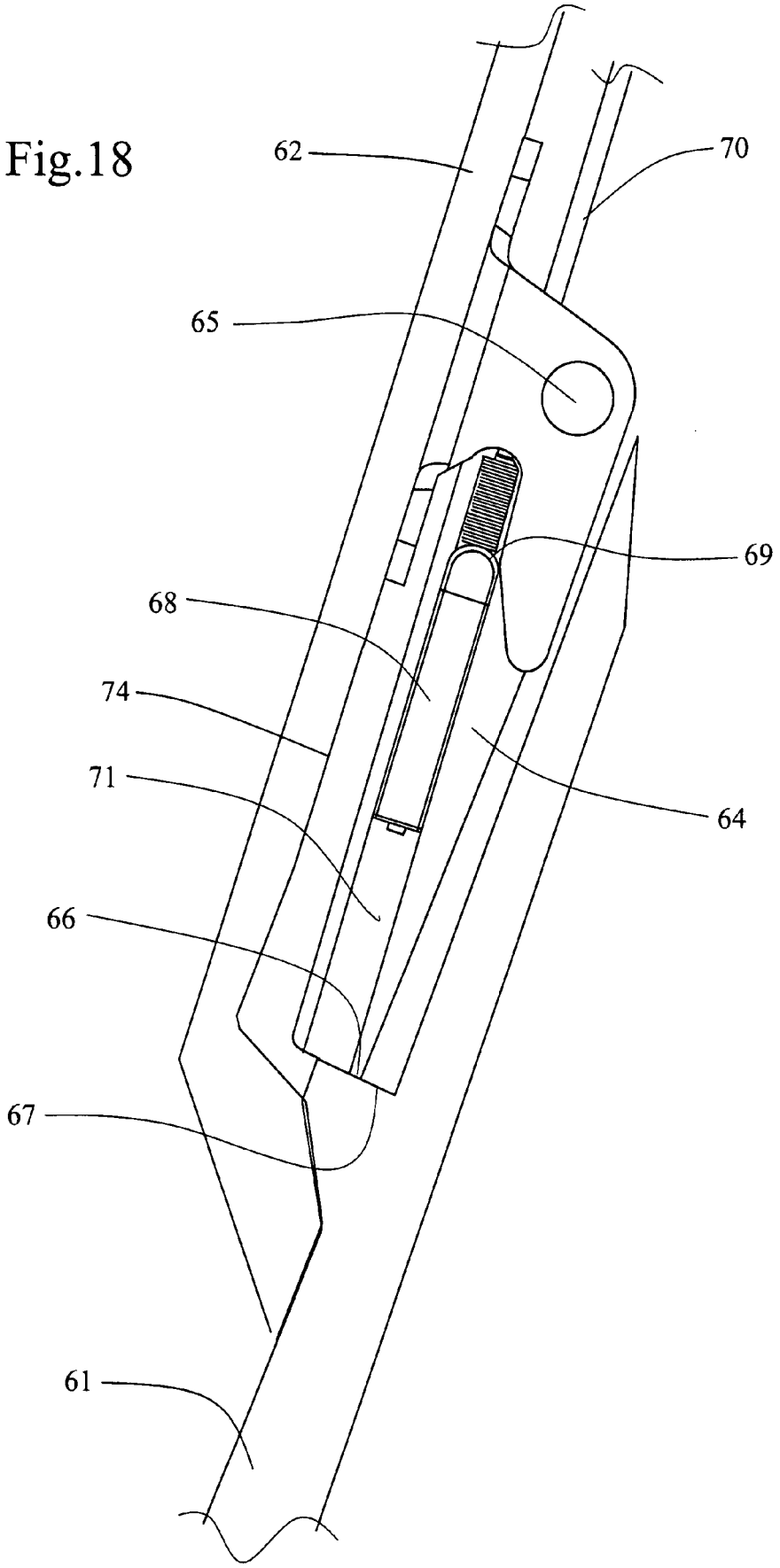
FIG. 18 is a side view in section on a vertical plane of part of a boot with a fastening mechanism according to the fourth embodiment of the invention in an unfastening phase.
Figure 19:
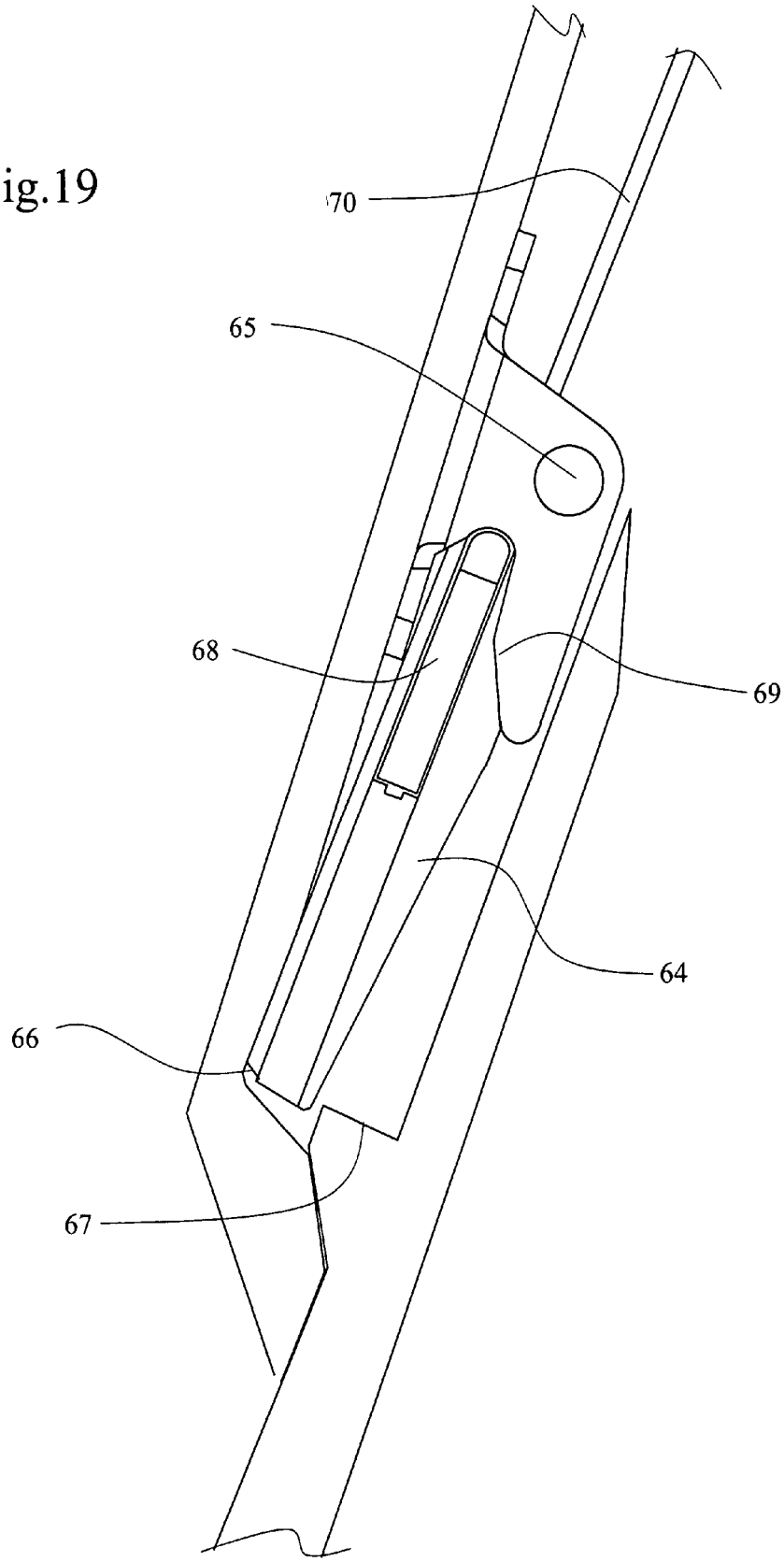
FIG. 19 is a side view in section on a vertical plane of part of a boot with a fastening mechanism according to the fourth embodiment of the invention in an unfastened position.
Figure 20:
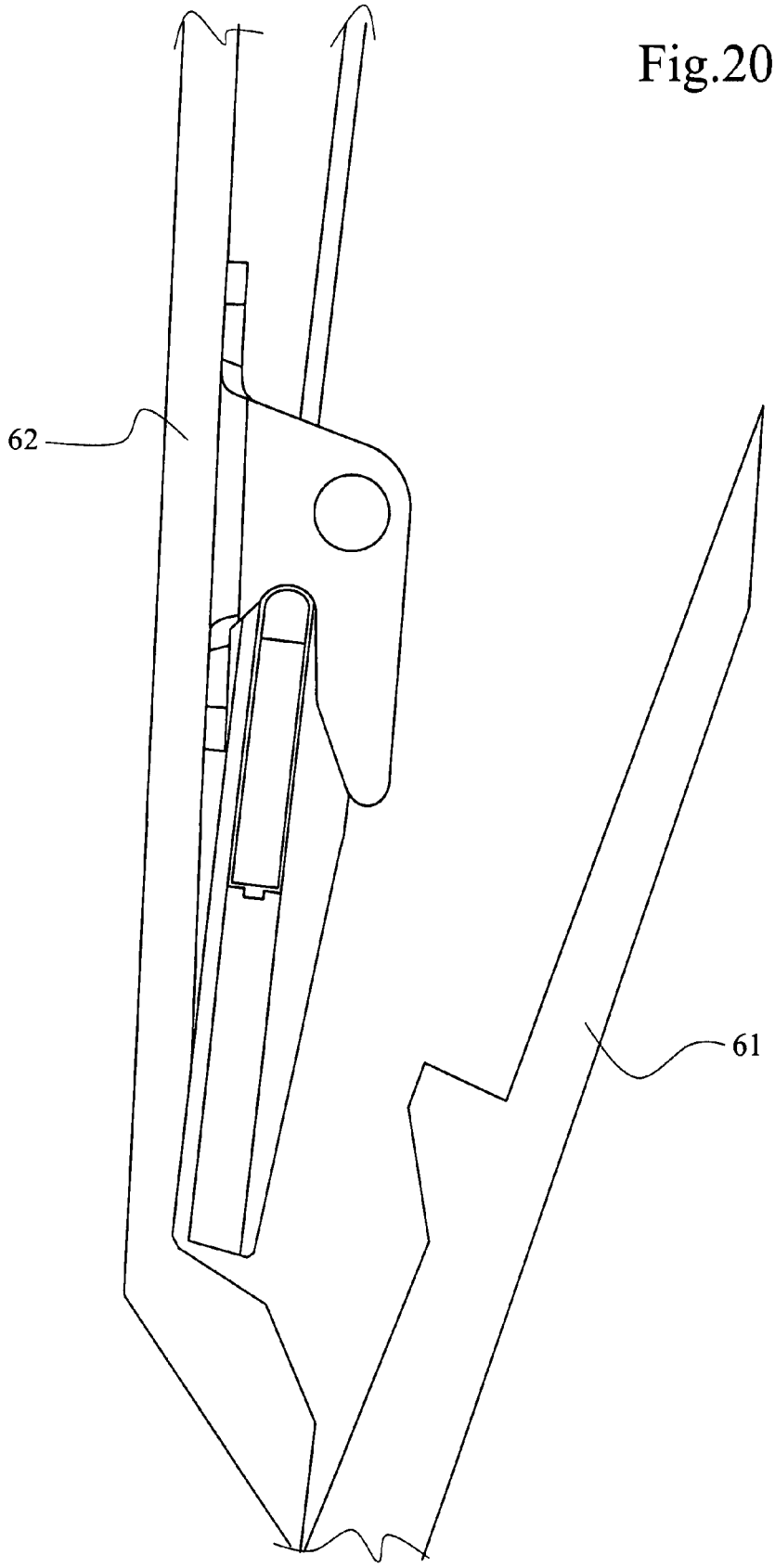
FIG. 20 is a side view in section on a vertical plane of part of a boot with a fastening mechanism according to the fourth embodiment of the invention in an unfastened position with the upper cuff stood up straight.

When the skier unfastens his boot buckle to which the end of the cable 70 is fixed, he introduces tension into this cable and this causes the slider 68 to move, compressing the spring 72. The slider reaches the cam surface 69, as depicted in FIG. 18, which will then impart to it a movement which will be passed on to the entire rocker 64. What actually happens is that the cam surface 69 forces the slider 68 against the interior surface 74 of the upper cuff 62 and in so doing drives the entire rocker, against the action of the spring 77. The end 66 of the rocker thus escapes the actions of the stop piece 67 of the shell 61 at the end of the travel of the slider 68, in the position depicted in FIG. 19. The upper cuff 62 is then free to rotate relative to the shell 61 to occupy a standing position illustrated in FIG. 20. Conversely, closing the boot buckle will release the cable 70 and the slider will then return to its fastened position illustrated in FIG. 16, under the effect of the compression spring 72.

Figure 21:
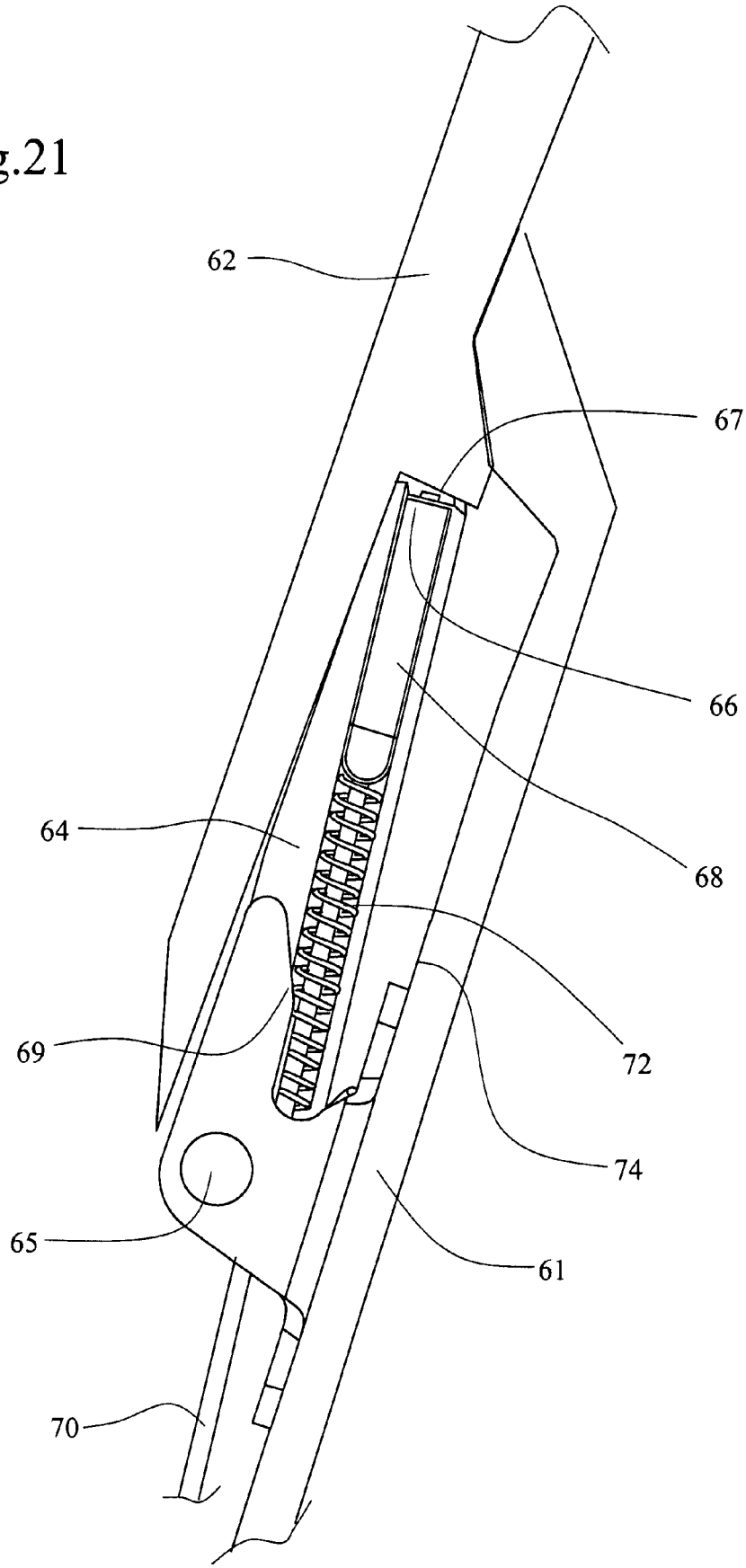
FIG. 21 is a side view in section on a vertical plane of part of a boot with a fastening mechanism according to an alternative form of the fourth embodiment of the invention, in a fastened position.

FIG. 21 depicts an alternative form of the fourth embodiment, in which the various elements remain the same and the operation remains identical, although their positions on the upper cuff and the shell are now reversed.

All of these embodiments illustrate the concept of the invention which relies on a combination of the following essential features:

- unfastening of the upper cuff is triggered under the effect of tension applied to the cable, so as to make good use of an effective force acting on the mechanism during this phase;
- the cable acts directly on an element which, through a special cam surface, will in a very simple way allow the mechanism to be fastened or unfastened, using a rocker.

The cable may be fixed by any means to a fastening and unfastening member, of the lever type for example. In addition, as illustrated hereinabove, this member may advantageously coincide with one of the buckles used to fasten the boot, which may be the top buckle 80 at shin level, or another buckle 81 at instep level, for example, so that undoing the device used to fasten the boot upper introduces tension into the cable. As intermediate alternative forms, this member could be separate from the buckle and independent of the movement of the buckle or operate in a way that is not completely independent but, for example, synchronized with, the movement of the buckle.

Alternative forms of embodiment can readily be achieved by modifying the components of the previous solutions symmetrically, some of these being allocated to the shell and others to the upper cuff. Thus, for example, it is possible to envisage a rocker connected to the shell or, just as readily, a rocker connected to the upper cuff, in collaboration with a stop piece positioned on either the upper cuff or the shell, respectively, as illustrated by FIGS. 16 and 21. Furthermore, alternative forms of embodiment may be obtained by combining the embodiments described hereinabove.

Ultimately, this solution affords the following advantages and achieves the desired objectives:

- the unfastening mechanism performs well because a strong tensile force is used to perform unfastening, this force being applied directly to the guiding of two elements in contact via a cam surface controlling the configuration of the fastening and unfastening device;

the mechanism is simple, inexpensive and occupies very little space because the components are few in number and not very bulky in format;

the long travel of the cable is converted into a small movement of a final element in order to escape the actions of a stop piece in a simple way using the cam surfaces proposed, without the need for numerous intermediate elements.

The invention claimed is:

1. A ski boot comprising a shell (1; 21; 41; 61) surrounding the foot and an upper cuff (2; 22; 42; 62) articulated to the shell, comprising a device for fastening and unfastening the upper cuff relative to the shell, this device being connected to a fastening and unfastening member by a cable (10; 30; 50; 70), this fastening and unfastening device being in a first, fastened, configuration when the fastening and unfastening member is in a first position in which the upper cuff is kept in a predefined inclined position relative to the shell, and in a second, unfastened, configuration when the fastening and unfastening member is in a second position in which the upper cuff is able to move relative to the shell so that it can be stood up straight, wherein the connection between the cable (10; 30; 50; 70) and the boot fastening and unfastening member is such that moving the fastening and unfastening member from the first to the second position introduces tension into the cable, this cable being directly connected to a control element (8; 28; 48; 68) able to change the configuration of the upper cuff fastening and unfastening device by action on a cam surface (9; 29; 49; 69).

2. The ski boot as claimed in claim 1, wherein the boot fastening and unfastening member is a boot fastening buckle (80), the first, fastened, configuration of the device corresponding to the fastening buckle being in the closed position, and the second configuration corresponding to its being in the open position.

3. The ski boot as claimed in claim 1, wherein the control element (8; 28) with the cam surface (9; 29) is a drum mounted such that it is able to move in terms of rotation and comprising a housing (11; 31) for the cable (10; 30) on its circumference, so that the cable rotates the drum when the fastening and unfastening member is actuated.

4. The ski boot as claimed in claim 3, wherein the diameter of the drum is such that the drum makes half a revolution when the cable covers a travel corresponding to its position between the first position and the second position of the fastening or unfastening member.

5. The ski boot as claimed in claim 3, wherein the cable is connected to the drum on which a return spring (12; 32) acts to return the cable to a taut position when it is released by the movement of the fastening or unfastening member into the first position.

6. The ski boot as claimed in claim 5, wherein the end of the cable is fixed directly to the drum or extended to be fixed to the drum return spring.

7. The ski boot as claimed in claim 3, wherein the drum is fixed to the interior surface (14; 34) of the upper cuff (2; 22) of the boot.

8. The ski boot as claimed in claim 3, wherein the drum (8) forms a disk of which the opposite surface to the one facing the surface of the boot has an irregular relief so as to form a cam surface (9) which collaborates with a rocker (4) mounted such that it can move in terms of rotation on the upper cuff (2) or on the shell (1) and the end (6) of which in the fastened configuration butts against a stop piece (7) belonging to the shell or to the upper cuff, respectively, and escapes the actions of this stop piece in the unfastened configuration.

9. The ski boot as claimed in claim 8, wherein the cam surface (9) of the drum (8) has a thicker disk portion (18) that comes into contact with the rocker (4), near its pivot (5) in the fastened configuration so as to hold it against the stop piece (7), and which has a thinner portion (19) in contact with the rocker (4) in the unfastened configuration in which the end (6) of the rocker escapes the actions of the stop piece (7) under the effect of a return spring (17).

10. The ski boot as claimed in claim 3, wherein the drum (28) with the cam surface (29) collaborates with a rocker (24) which in the fastened configuration comes into abutment with this rocker (24) and in the unfastened configuration escapes the actions of this stop piece.

11. The ski boot as claimed in claim 10, wherein the drum (28) forms a disk with a thicker portion (38), the annular surface of which is in contact with the rocker (24) in the fastened configuration and a thinner portion (39) of which faces this rocker (24) in the unfastened configuration so as not to butt against it.

12. The ski boot as claimed in claim 1, wherein the control element (48; 68) is a slider mounted such that it can move in terms of translation and connected to the cable (50; 70) at its end part, so that the cable drives the slider in a translational movement when the fastening and unfastening member is actuated.

13. The ski boot as claimed in claim 12, wherein a compression spring (52; 72) is positioned between the slider and a stop piece (53; 73) so that the cable (50; 70) can be returned to a taut position when it is released by the fastening and unfastening member moving into the first position.

14. The ski boot as claimed in claim 12, wherein the slider (48) is mounted near the interior surface (54) of the upper cuff (42) of the boot.

15. The ski boot as claimed in claim 14, wherein the slider collaborates with a cam surface (49) of a rocker (44) mounted such that it can move in terms of rotation so that the slider lies in a position close to the end of the rocker (46) and bears against a surface (59) in the unfastened configuration so as to keep it away from a stop piece (47) and so that the slider lies in a position further away from the end of the rocker (46) and bearing against a hollowed surface (58) of the rocker (44) in the fastened position so that the rocker is kept collaborating with the stop piece (47) in this configuration under the effect of its return spring (57).

16. The ski boot as claimed in claim 15, wherein the slider (48) moves inside an opening (51), forming guideways, of a support piece (55) positioned on the interior surface of the upper cuff (42).

17. The ski boot as claimed in claim 12, wherein the slider (68) is mounted inside an opening of a rocker (64), mounted such that it can move in terms of rotation about a pivot (65) positioned between two arms (76) of a support (75).

18. The ski boot as claimed in claim 17, wherein the slider (68) comes into contact with a cam surface (69) of an arm (76) of the support (75) when the cable (70) is pulled under the effect of the fastening and unfastening member moving into the second position, so that the slider (68) drives the rocker (64) in a rotational movement until its end (66) escapes the actions of its stop piece (67) in the unfastened configuration.

* * * * *